US011193490B2

(12) United States Patent
Kuma et al.

(10) Patent No.: US 11,193,490 B2
(45) Date of Patent: Dec. 7, 2021

(54) SCROLL COMPRESSOR INCLUDING BUSHING MOUNTED ON ECCENTRIC SHAFT CONTAINING CYLINDRICAL AND AUXILIARY WEIGHT PORTIONS AND BALANCER DISPOSED ABOVE ANNULAR ROTOR REMOTE FROM BACK PRESSURE CHAMBER

(71) Applicant: KABUSHIKI KAISHA TOYOTA JIDOSHOKKI, Kariya (JP)

(72) Inventors: Hirofumi Kuma, Kariya (JP); Kazuo Murakami, Kariya (JP); Masashi Wakui, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 155 days.

(21) Appl. No.: 16/367,699

(22) Filed: Mar. 28, 2019

(65) Prior Publication Data

US 2019/0301464 A1 Oct. 3, 2019

(30) Foreign Application Priority Data

Mar. 30, 2018 (JP) ..... JP2018-070071
Mar. 13, 2019 (JP) ..... JP2019-046130

(51) Int. Cl.
*F04C 29/00* (2006.01)
*F04C 18/02* (2006.01)
*F04C 23/00* (2006.01)

(52) U.S. Cl.
CPC ..... *F04C 29/0021* (2013.01); *F04C 18/0215* (2013.01); *F04C 23/008* (2013.01);
(Continued)

(58) Field of Classification Search
CPC ..... F04C 29/0021; F04C 18/0215; F04C 2240/807; F04C 29/0057; F04C 2210/263; F04C 23/008; F04C 2210/22
See application file for complete search history.

(56) References Cited

U.S. PATENT DOCUMENTS 4,854,831 A * 8/1989 Etemad ..... F04C 23/008 417/366
5,263,822 A * 11/1993 Fujio ..... F04C 29/025 418/55.4

(Continued)

FOREIGN PATENT DOCUMENTS

JP 4625590 B2 2/2011
JP 2014-173436 A 9/2014
JP 2015-68248 A 4/2015

*Primary Examiner* — Mary Davis
*Assistant Examiner* — Paul W Thiede
(74) *Attorney, Agent, or Firm* — Sughrue Mion, PLLC

(57) ABSTRACT

A scroll compressor includes a balancer that rotates integrally with a rotary shaft. A bushing includes a cylindrical portion and an auxiliary weight portion. The auxiliary weight portion is arranged on the outer side of the cylindrical portion. The fitting hole is provided at a position where a moment about the eccentric shaft generated by a centrifugal force acting on the movable scroll due to rotation of the rotary shaft and a moment about the eccentric shaft generated by a centrifugal force acting on the auxiliary weight portion due to rotation of the rotary shaft are in the opposite directions. As viewed in the axial direction of the rotary shaft, the center of gravity of the bushing is located on the same side of a straight line including the center of the cylindrical portion and the center of the rotary shaft as the center of the eccentric shaft.

13 Claims, 4 Drawing Sheets

(52) U.S. Cl.
CPC ..... *F04C 29/00* (2013.01); *F04C 2240/56* (2013.01); *F04C 2240/807* (2013.01); *F05B 2240/50* (2013.01); *F05B 2260/966* (2013.01)

(56) References Cited

U.S. PATENT DOCUMENTS

| | | | | |
|---|---|---|---|---|
| 9,976,556 | B2 * | 5/2018 | Nagaoka | F04C 29/026 |
| 10,208,750 | B2 * | 2/2019 | Kawamura | F04C 29/0057 |
| 10,859,083 | B2 * | 12/2020 | Takamura | F04C 18/0215 |
| 2009/0110580 | A1 * | 4/2009 | Suefuji | F01C 17/063 418/55.2 |
| 2011/0200471 | A1 * | 8/2011 | Kato | F01C 21/10 417/437 |
| 2014/0255231 | A1 | 9/2014 | Kii | |
| 2015/0093276 | A1 | 4/2015 | Kanemoto et al. | |
| 2015/0125330 | A1 * | 5/2015 | Komura | F04C 29/042 418/55.1 |
| 2015/0354572 | A1 * | 12/2015 | Yokoyama | F04C 18/0261 62/469 |
| 2017/0082109 | A1 * | 3/2017 | Kawamura | F04C 29/0057 |
| 2017/0089624 | A1 * | 3/2017 | Yokoyama | F04C 29/045 |

* cited by examiner

SCROLL COMPRESSOR INCLUDING BUSHING MOUNTED ON ECCENTRIC SHAFT CONTAINING CYLINDRICAL AND AUXILIARY WEIGHT PORTIONS AND BALANCER DISPOSED ABOVE ANNULAR ROTOR REMOTE FROM BACK PRESSURE CHAMBER

BACKGROUND

1. Field

The present disclosure relates to a scroll compressor that includes a bushing fitted to an eccentric shaft and a balancer that rotates integrally with a rotary shaft.

2. Description of Related Art

A typical scroll compressor has a mechanism that changes the orbital radius of the movable scroll in order to maintain a proper contact pressure between the volute wall of the movable scroll and the volute wall of the stationary scroll. A structure in which a bushing is provided between the eccentric shaft and the movable scroll is known as such a mechanism. The eccentric shaft is located at one end face in the axial direction of the rotary shaft. The eccentric shaft is fitted in the bushing. The bushing supports the movable scroll via a bearing. When the rotary shaft rotates, the movable scroll orbits about the eccentric shaft. At this time, the orbital radius of the movable scroll changes due to swinging motion of the bushing within a specified range.

The bushing receives the centrifugal force generated by the orbiting motion of the movable scroll, so that a moment is generated about the eccentric shaft in the bushing. This applies a load to the bearing that support the rotary shaft. In order to reduce the load applied to the bearing, a structure in which a balancer is integrated with a bushing has been known in the art as disclosed in Japanese Laid-Open Patent Publication No. 2014-173436. In this case, when the bushing integrated with a balancer orbits in response to rotation of the rotary shaft, the balancer is swung by the centrifugal force. This generates a moment about the eccentric shaft in the bushing. The direction of the moment is opposite to the direction of the moment generated by the centrifugal force of the movable scroll. These moments thus cancel each other, reducing the load applied to a rotary shaft bearing, which supports the rotary shaft.

However, when a bushing integrated with a balancer swings, the balancer swings simultaneously. Since the balancer is heavier than the bushing, the swinging motion of the balancer is likely to worsen vibration of the rotary shaft. In this regard, the scroll compressor in, for example, Japanese Laid-Open Patent Publication No. 2015-68248 has a balancer separate from the bushing. The balancer is fixed to the rotary shaft and rotates integrally with the rotary shaft. The balancer thus does not swing, so that vibration of the rotary shaft is not worsened.

However, in the scroll compressor of Japanese Laid-Open Patent Publication No. 2015-68248, since the balancer is separate from the bushing, the moment due to the centrifugal force acting on the movable scroll cannot be cancelled by the balancer. Thus, the load applied to the rotary shaft bearing cannot be reduced. As a result, it is necessary to enlarge the rotary shaft bearing in order to withstand the load applied to the rotary shaft bearing.

SUMMARY

Accordingly, it is an objective of the present disclosure to provide a scroll compressor capable of suppressing vibration of the rotary shaft that accompanies swinging motion of the balancer and reducing the load applied to the rotary shaft bearing.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a scroll compressor is provided that includes a rotary shaft, an eccentric shaft that is provided at a distal end of the rotary shaft, a stationary scroll that has a stationary-side base plate and a stationary-side volute wall extending from the stationary-side base plate, a moveable scroll that is configured to compress fluid by rotation of the rotary shaft, a shaft supporting member, a bushing, a scroll bearing, and a balancer. The movable scroll includes a disk-shaped movable-side base plate that faces the stationary-side base plate, a movable-side volute wall that extends from the movable-side base plate toward the stationary-side base plate and meshes with the stationary-side volute wall, and a cylindrical boss portion that extends from the movable-side base plate toward the rotary shaft and is arranged about a central axis of the movable-side base plate. The shaft supporting member has an insertion hole in which the rotary shaft is inserted, a rotary shaft bearing for supporting the rotary shaft being arranged in the insertion hole. The bushing has a fitting hole in which the eccentric shaft is fitted. The scroll bearing is fitted to an inner circumferential surface of the boss portion and fitted to an outer circumferential surface of the bushing. The balancer rotates integrally with the rotary shaft and has a main weight portion located on an opposite side of a central axis of the rotary shaft from the eccentric shaft. The central axis of the movable-side base plate is located at a different position from the central axis of the eccentric shaft. The bushing includes a cylindrical portion and an auxiliary weight portion. The cylindrical portion is fitted to an inner circumferential surface of the scroll bearing. The fitting hole extends through the cylindrical portion along an axial direction of the cylindrical portion. The auxiliary weight portion is located on an outer side of the cylindrical portion in a radial direction. The fitting hole is provided at a position where a moment about the eccentric shaft generated by a centrifugal force acting on the movable scroll due to rotation of the rotary shaft and a moment about the eccentric shaft generated by a centrifugal force acting on the auxiliary weight portion due to rotation of the rotary shaft are in opposite directions. As viewed in an axial direction of the rotary shaft, a center of gravity of the bushing is located on a same side of a straight line including a center of the cylindrical portion and a center of the rotary shaft as a center of the eccentric shaft.

With this configuration, the main weight portion of the balancer integrated with the rotary shaft achieves weight balance with the movable scroll. Since the balancer is separate from the bushing, the balancer does not swing simultaneously with the bushing. Therefore, it is possible to suppress the vibration of the rotary shaft generated by swinging motion of the balancer. The position of the fitting hole is adjusted such that the moment generated by the centrifugal force acting on the movable scroll and the moment generated by the centrifugal force acting on the auxiliary weight portion are in the opposite directions. The adjustment of the position of the fitting hole cancels the moment about the eccentric shaft, so that the load applied to the rotary shaft bearing is reduced. This reduces the size of the rotary shaft bearing.

The center of gravity of the bushing is located on the same side of the straight line including the center of the cylindrical portion and the center of the rotary shaft as the center of the eccentric shaft. This increases the moment about the eccentric shaft generated by the centrifugal force acting on the auxiliary weight portion. This allows the auxiliary weight portion to be reduced in size.

In the scroll compressor, as viewed in the axial direction of the rotary shaft, a center of gravity of the auxiliary weight portion is preferably located on the same side of the straight line including the center of the cylindrical portion and the center of the rotary shaft as the center of the eccentric shaft. This further increases the moment about the eccentric shaft generated by the centrifugal force acting on the auxiliary weight portion, allowing the auxiliary weight to be reduced in size.

In the scroll compressor, as viewed in the axial direction of the rotary shaft, the auxiliary weight portion is preferably entirely located on the same side of the straight line including the center of the cylindrical portion and the center of the rotary shaft as the center of the eccentric shaft. This further increases the moment about the eccentric shaft generated by the centrifugal force acting on the auxiliary weight portion, allowing the auxiliary weight to be reduced in size.

In the scroll compressor, the auxiliary weight portion may include a thin portion that extends from an outer circumferential surface of the cylindrical portion in a radial direction of the cylindrical portion and a thick portion that is provided on an outer side of the thin portion in the radial direction and has a dimension in the axial direction of the rotary shaft that is greater than that of the thin portion. As viewed in the axial direction of the rotary shaft, the thick portion may be entirely located on the same side of the straight line including the center of the cylindrical portion and the center of the rotary shaft as the center of the eccentric shaft.

With this configuration, even if the position of the bushing relative to the rotary shaft changes to a certain degree due to manufacturing tolerances of the bushing or assembly tolerances between the bushing and the rotary shaft, the center of gravity of the bushing is located on the same side of the straight line including the center of the cylindrical portion and the center of the rotary shaft as the center of the eccentric shaft. This further increases the moment about the eccentric shaft generated by the centrifugal force acting on the auxiliary weight portion, allowing the auxiliary weight to be reduced in size.

In another general aspect, a scroll compressor is provided that includes a rotary shaft, an eccentric shaft that is provided at a distal end of the rotary shaft, a stationary scroll that has a stationary-side base plate and a stationary-side volute wall extending from the stationary-side base plate, a movable scroll that is configured to compress fluid by rotation of the rotary shaft, a shaft supporting member, a bushing, a scroll bearing, and a balancer. The movable scroll includes a disk-shaped movable-side base plate that faces the stationary-side base plate, a movable-side volute wall that extends from the movable-side base plate toward the stationary-side base plate and meshes with the stationary-side volute wall, and a cylindrical boss portion that extends from the movable-side base plate toward the rotary shaft and is arranged about a central axis of the movable-side base plate. The shaft supporting member has an insertion hole in which the rotary shaft is inserted. A rotary shaft bearing for supporting the rotary shaft is arranged in the insertion hole. The bushing has a fitting hole in which the eccentric shaft is fitted. The scroll bearing is fitted to an inner circumferential surface of the boss portion and fitted to an outer circumferential surface of the bushing. The balancer rotates integrally with the rotary shaft and has a main weight portion located on an opposite side of a central axis of the rotary shaft from the eccentric shaft. The central axis of the movable-side base plate is located at a different position from the central axis of the eccentric shaft. The bushing includes a cylindrical portion and an auxiliary weight portion. The cylindrical portion is fitted to an inner circumferential surface of the scroll bearing. The fitting hole extends through the cylindrical portion along an axial direction of the cylindrical portion. The auxiliary weight portion is located on an outer side of the cylindrical portion in a radial direction. The auxiliary weight portion includes a thin portion and a thick portion. The thin portion extends from an outer circumferential surface of the cylindrical portion in a radial direction of the cylindrical portion. The thick portion is provided on an outer side of the thin portion in the radial direction and has a dimension in an axial direction of the rotary shaft that is greater than that of the thin portion. As viewed in the axial direction of the rotary shaft, the thick portion is entirely located on an opposite side of a straight line including a center of the eccentric shaft and a center of the rotary shaft from a center of the movable-side base plate.

With this configuration, the main weight portion of the balancer integrated with the rotary shaft achieves weight balance with the movable scroll. Since the balancer is separate from the bushing, the balancer does not swing simultaneously with the bushing. Therefore, it is possible to suppress the vibration of the rotary shaft generated by swinging motion of the balancer. If the center of the movable-side base plate and the center of gravity of the movable scroll are substantially at the same position, and the thick portion is entirely located in the area opposite from the center, the center of gravity of the bushing is also within that area. Thus, the moment about the eccentric shaft generated by the centrifugal force acting on the movable scroll due to rotation of the rotary shaft and the moment about the eccentric shaft generated by the centrifugal force acting on the auxiliary weight portion due to rotation of the rotary shaft are in the opposite directions. Therefore, the moment about the eccentric shaft is cancelled, reducing the load applied to the rotary shaft bearing. This reduces the size of the rotary shaft bearing.

In the scroll compressor, at least a part of the thick portion may be arranged to face an outer circumferential surface of the boss portion in the radial direction of the cylindrical portion. Also, the thin portion may be arranged between the scroll bearing and the rotary shaft in the axial direction of the rotary shaft.

With this configuration, the thick portion of the auxiliary weight portion is arranged on the outer side of the outer circumferential surface of the boss portion in the bushing, and the thin portion is arranged between the scroll bearing and the rotary shaft with its dimensions adjusted. Thus, although this allows the bushing, which is separate from the balancer, to swing and reduces the load applied to the rotary shaft bearing, it is not necessary to increase the size of the rotary shaft bearing. As a result, there is no need to increase the size of the scroll compressor.

In the scroll compressor, a back pressure chamber may be defined between the movable-side base plate and the shaft supporting member. The back pressure chamber is configured to introduce fluid for pressing the movable scroll against the stationary scroll. The main weight portion and the auxiliary weight portion are arranged in the back pressure chamber.

With this configuration, the main weight portion and the auxiliary weight portion are arranged in the back pressure chamber, which is an existing structure of the scroll compressor. This eliminates the necessity for providing a space for accommodating the main weight portion and the auxiliary weight portion. Therefore, the scroll compressor is not increased in size in order to provide an accommodation space for the main weight portion and the auxiliary weight portion.

In the scroll compressor, the movable scroll may include an anti-rotation mechanism. At least a part of the thick portion may be arranged on an inner side of the anti-rotation mechanism in a radial direction of the rotary shaft.

With this configuration, the thick portion of the auxiliary weight portion of the busing is located on the inner side of the anti-rotation mechanism in the radial direction. Thus, there is no need to increase the size of the scroll compressor.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

A scroll compressor 10 according to a first embodiment will now be described with reference to FIGS. 1 to 3.

Figure 1:
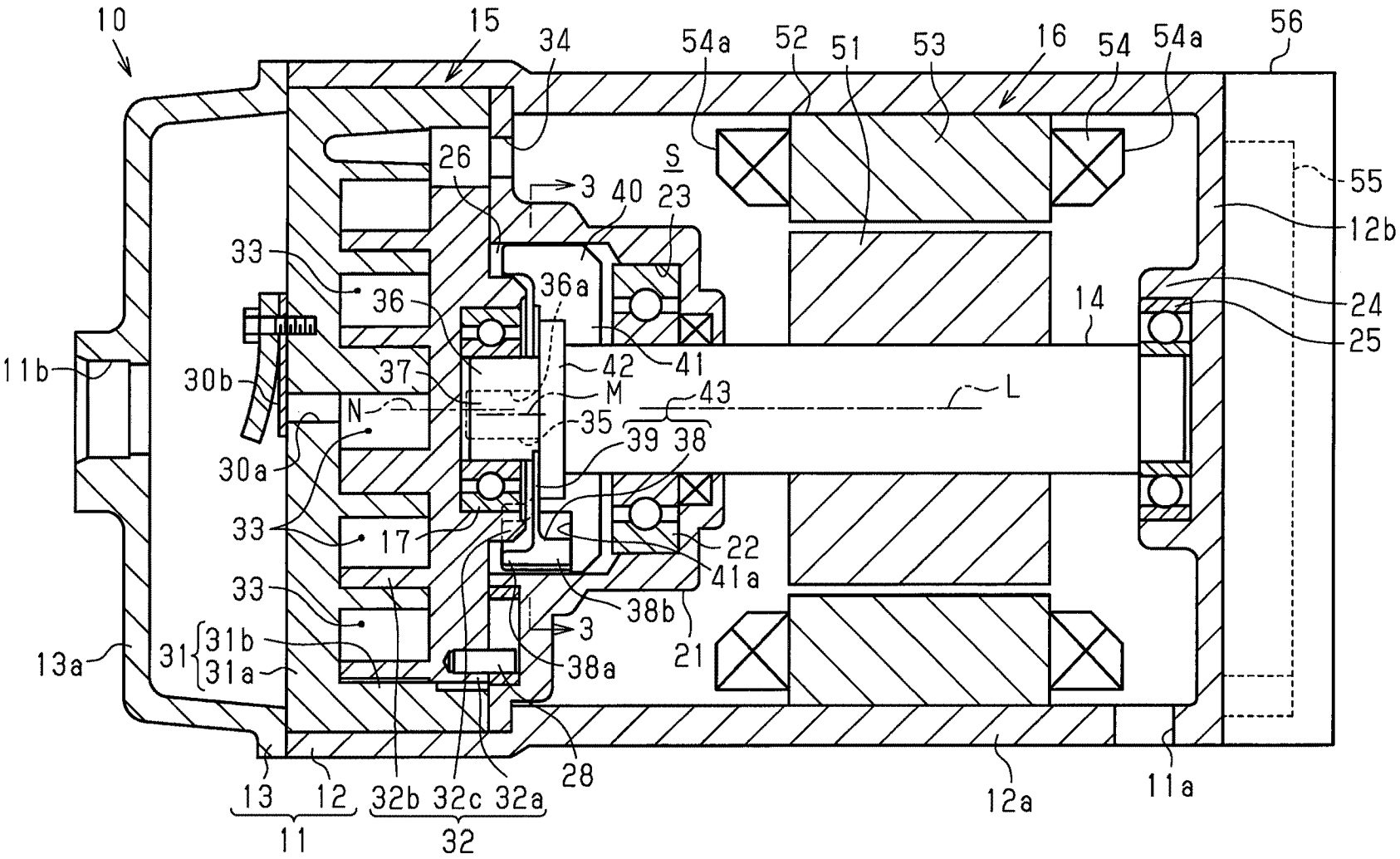
FIG. 1 is a cross-sectional view showing a scroll compressor of according to a first embodiment.

As shown in FIG. 1, the scroll compressor 10 includes a housing 11. The housing 11 has an inlet 11*a*, through which fluid is drawn in, and an outlet 11*b*, from which fluid is discharged. The housing 11 has a substantially cylindrical shape as a whole. The housing 11 includes a compressor housing member 13, a motor housing member 12, and a cover member 56, which are arranged in order in the axial direction.

The compressor housing member 13 has a circumferential wall, which opens at one end, and an end wall 13*a*, which closes the other end of the circumferential wall. The motor housing member 12 has a circumferential wall 12*a*, which opens at one end, and an end wall 12*b*, which closes the other end of the circumferential wall 12*a*. The cover member 56 has a circumferential wall, which opens at one end, and an end wall, which closes the other end of the circumferential wall. The cover member 56 is attached to the motor housing member 12 such that the open end thereof is in contact with the outer edge of the circumferential wall 12*a*. The motor housing member 12 and the compressor housing member 13 are assembled together with their open ends abutting each other. The inlet 11*a* extends through the circumferential wall 12*a* of the motor housing member 12, more specifically, a portion of the circumferential wall 12*a* that is close to the end wall 12*b*. The outlet 11*b* extends through the end wall 13*a* of the compressor housing member 13.

The scroll compressor 10 has a rotary shaft 14, a compression portion 15, and an electric motor 16 that drives the compression portion 15. In the following description, unless otherwise specified, the direction along the central axis L of the rotary shaft 14 is referred to as an axial direction, and the radial direction of the rotary shaft 14 is referred to as a radial direction. The compression portion 15 is configured to compress fluid drawn in through the inlet 11*a* and discharges it from the outlet 11*b*. The rotary shaft 14, the compression portion 15, and the electric motor 16 are accommodated in the housing 11. The electric motor 16 is located closer to the inlet 11*a* in the housing 11 than the compression portion 15. The compression portion 15 is located closer to the outlet 11*b* in the housing 11 than the electric motor 16.

The rotary shaft 14 is rotationally accommodated in the housing 11. Specifically, the housing 11 accommodates a cylindrical shaft supporting member 21, which supports the rotary shaft 14. The shaft supporting member 21 is fixed to the housing 11, for example, at a position between the compression portion 15 and the electric motor 16. The shaft supporting member 21 defines a motor accommodating chamber S in the housing 11.

The shaft supporting member 21 has an insertion hole 23 through which the rotary shaft 14 is inserted. A first bearing 22, which is a rotary shaft bearing, is arranged in the insertion hole 23. The shaft supporting member 21 and the end wall 12*b* of the motor housing member 12 are arranged side by side in the axial direction. A cylindrical bearing cylinder portion 24 protrudes from the end wall 12*b*. A second bearing 25 is arranged on the radially inner side of the bearing cylinder portion 24. The rotary shaft 14 is rotationally supported by the first bearing 22 and the second bearing 25. The rotary shaft 14 has a first end (left end in FIG. 1, also referred to as a distal end) and a second end (the right end in FIG. 1), which are supported by the first bearing 22 and the second bearing 25, respectively.

The compression portion 15 includes a stationary scroll 31, which is fixed to the housing 11, and a movable scroll 32, which compresses fluid. The movable scroll 32 is capable of orbiting in relation to the stationary scroll 31. The stationary scroll 31 has a disk-shaped stationary-side base plate 31*a*, which is coaxial with the rotary shaft 14, a stationary-side volute wall 31*b*, which extends from the stationary-side base plate 31*a*, and a discharge port 30*a*, which extends through the stationary-side base plate 31*a*. Likewise, the movable scroll 32 has a disk-shaped movable-side base plate 32*a* and a movable-side volute wall 32*b*. The movable-side base plate 32*a* is arranged to face the stationary-side base plate 31*a*. The movable-side volute wall 32*b* extends in the axial direction from the movable-side base plate 32*a* toward the stationary-side base plate 31*a*. The movable scroll 32 has a cylindrical boss portion 32*c* extending from the movable-side base plate 32*a* toward the shaft supporting member 21. The boss portion 32*c* is located inside the insertion hole 23 of the shaft supporting member 21. A scroll bearing 17 is arranged on the radially inner side of the boss portion 32*c*. The boss portion 32*c* is located about the central axis N of the movable-side base plate 32*a*, and the central axis of the boss portion 32*c* coincides with the central axis N of the movable-side base plate 32*a*.

The stationary scroll 31 and the movable scroll 32 mesh with each other. Specifically, the stationary-side volute wall 31*b* and the movable-side volute wall 32*b* mesh with each other such that the distal end face of the stationary-side volute wall 31*b* is in contact with the movable-side base plate 32*a*, and the distal end face of the movable-side volute wall 32*b* is in contact with the stationary-side base plate 31*a*. The stationary scroll 31 and the movable scroll 32 define a compression chamber 33 for compressing fluid.

The shaft supporting member 21 has a suction passage 34 for drawing in suction fluid into the compression chamber 33. The end face of the shaft supporting member 21 is closed by the movable-side base plate 32*a* with the boss portion 32*c* received in the inner space formed by the shaft supporting member 21. A back pressure chamber 26 is defined in this closed space. High pressure control gas is introduced into the back pressure chamber 26. The flow of the introduced control gas pushes the movable scroll 32 against the stationary scroll 31 along the central axis L of the rotary shaft 14.

The movable scroll 32 is configured to orbit as the rotary shaft 14 rotates. A first end face (the left end face in FIG. 1) of the rotary shaft 14 is closer to the compression portion 15 than the insertion hole 23 of the shaft supporting member 21. An eccentric shaft 35 extends in the axial direction from the first end of the rotary shaft 14. The eccentric shaft 35 has a central axis M eccentric to the central axis L. The central axis M of the eccentric shaft 35 is offset in the radial direction from the central axis L of the rotary shaft 14 and located at a different position from the central axis N of the movable-side base plate 32*a*. More specifically, the central axis M of the eccentric shaft 35, the central axis L of the rotary shaft 14, and the central axis N of the movable-side base plate 32*a* are parallel to one another. The movable scroll 32 is rotationally supported by the eccentric shaft 35 via the bushing 36 and the scroll bearing 17.

The scroll compressor 10 includes anti-rotation mechanisms 28, which allow the movable scroll 32 to orbit. The anti-rotation mechanisms 28 are configured to restrict rotation of the movable scroll 32 that would be caused by the action of compressive force. When the rotary shaft 14 rotates in a predetermined forward direction (clockwise), the movable scroll 32 revolves in the forward direction. This motion is referred to as orbing motion in the forward direction of the movable scroll 32. The movable scroll 32 orbits clockwise about the central axis L of the rotary shaft 14. The volume of the compression chamber 33 decreases accordingly, so that the suction fluid drawn into the compression chamber 33 through the suction passage 34 is compressed. The compressed fluid is discharged from the discharge port 30*a* and then discharged from the outlet 11*b*. The stationary-side base plate 31*a* is provided with a discharge valve 30*b*, which covers the discharge port 30*a*. The fluid compressed in the compression chamber 33 is discharged from the discharge port 30*a* by flexing the discharge valve 30*b*, while applying a compressive force to the movable scroll 32.

When the electric motor 16 rotates the rotary shaft 14, the movable scroll 32 orbits. The electric motor 16 has an annular rotor 51, which rotates integrally with the rotary shaft 14, and a stator 52, which surrounds the outer circumference of the rotor 51. The rotor 51 is coupled to the rotary shaft 14. The rotor 51 has permanent magnets (not shown). The stator 52 is fixed to the inner circumferential surface of the housing 11 (more specifically, the motor housing member 12). The stator 52 includes a stator core 53, which faces the rotor 51 in the radial direction, and a coil 54 wound about the stator core 53. The coil 54 has two coil ends 54*a* respectively projecting from the opposite end faces in the axial direction of the stator core 53.

The scroll compressor 10 is provided with an inverter 55, which is a drive circuit that drives the electric motor 16. The inverter 55 is accommodated in the housing 11, specifically, in the cover member 56. The inverter 55 is electrically connected to the coil 54.

Next, a mechanism that achieves weight balance during the orbiting motion of the movable scroll 32 will be described.

The bushing 36 has a cylindrical portion 37, a fitting hole 36*a* extending through the cylindrical portion 37, and an auxiliary weight portion 43 located on the outer side of the cylindrical portion 37 in the radial direction. The eccentric shaft 35 is fitted in the fitting hole 36*a*. The auxiliary weight portion 43 includes a thin portion 39, which extends from the outer circumferential surface of the cylindrical portion 37 in the radial direction of the cylindrical portion 37, and a thick portion 38. The dimension in the axial direction (thickness) of the thick portion 38 is greater than that of the thin portion 39. The thick portion 38 is located on the outer side of the thin portion 39 in the radial direction of the cylindrical portion 37.

The inner circumferential surface of the cylindrical portion 37 is fitted to the outer circumferential surface of the eccentric shaft 35. The outer circumferential surface of the cylindrical portion 37 is fitted to the inner circumferential surface of the scroll bearing 17. The bushing 36 is rotationally supported by the scroll bearing 17. The center (central axis) of the cylindrical portion 37 coincides with the center of the movable-side base plate 32*a* when the movable-side base plate 32*a* is viewed in the axial direction of the rotary shaft 14, and also coincides with the center of gravity of the movable scroll 32 when viewed in the axial direction of the rotary shaft 14. The central axis of the cylindrical portion 37 is thus referred to as the central axis N. The center of the cylindrical portion 37 is located on the central axis N when viewed in the axial direction of the rotary shaft 14.

Figure 3:
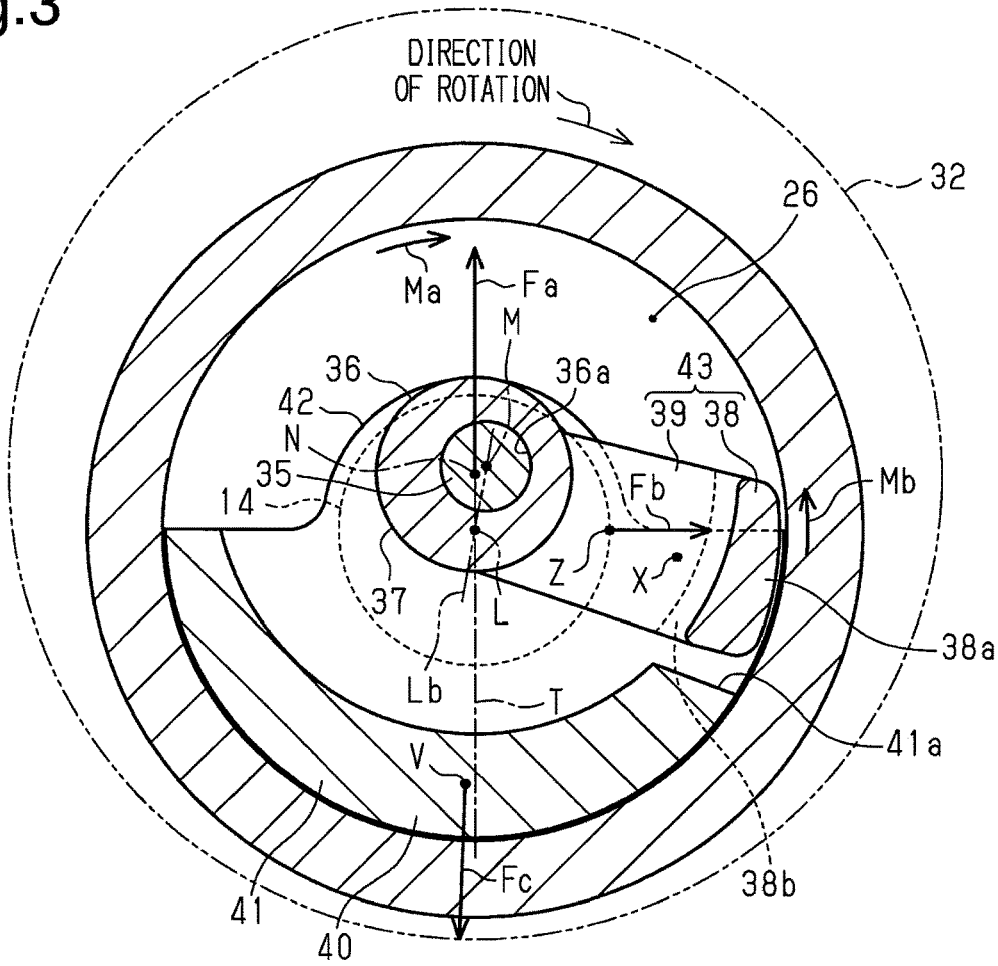
FIG. 3 is a cross-sectional view taken along line 3-3 in FIG. 1, showing the rotary shaft, the balancer, and the bushing.

As shown in FIG. 3, the eccentric shaft 35 is fitted in the fitting hole 36*a* of the bushing 36, and the central axis of the fitting hole 36*a* coincides with the central axis M of the eccentric shaft 35. The central axis of the fitting hole 36*a* is thus referred to as the central axis M. The center of the fitting hole 36*a* is located on the central axis M when viewed in the axial direction of the rotary shaft 14. The central axis M of the fitting hole 36*a* is located on the outer side of the central axis N of the cylindrical portion 37 in the radial direction. Specifically, the central axis M of the fitting hole 36*a* is closer to the auxiliary weight portion 43 than the central axis N of the cylindrical portion 37 and further away in the radial direction from a balancer 40, which will be discussed below, than the central axis N. When a load is applied to the bushing 36 by the orbiting motion of the movable scroll 32, the eccentric shaft 35 is located ahead of the central axis N of the cylindrical portion 37 in the direction in which the load is applied, so that the eccentric shaft 35 acts to pull the bushing 36.

The central axis N of the cylindrical portion 37, that is, the center of the cylindrical portion 37, is offset in the radial direction from the central axis M of the fitting hole 36*a* and eccentric shaft 35, that is, from the center of the fitting hole 36*a* and the eccentric shaft 35. As viewed in the axial direction of the rotary shaft 14, the center (central axis M) of the fitting hole 36*a* and the eccentric shaft 35 is closer to the auxiliary weight portion 43 than a straight line T that includes the center (central axis L) of the rotary shaft 14 and the center (central axis N) of the cylindrical portion 37.

Figure 2:
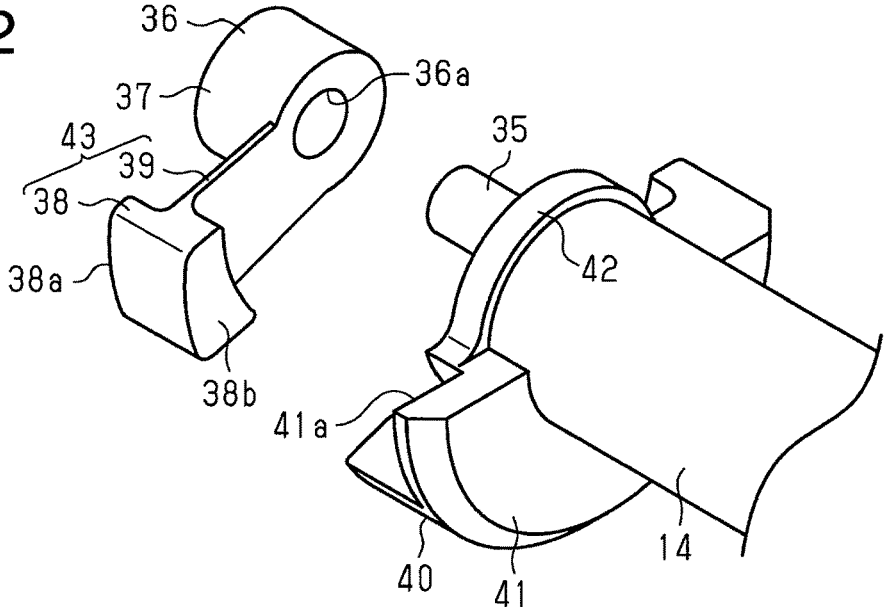
FIG. 2 is an exploded perspective view showing the rotary shaft, the balancer, and the bushing of the scroll compressor shown in FIG. 1.

As shown in FIGS. 1 and 2, the thin portion 39 of the auxiliary weight portion 43 protrudes in the radial direction from a section of the outer circumferential surface of the cylindrical portion 37 that protrudes further toward the rotary shaft 14 than the scroll bearing 17. The thin portion 39 is a thin plate and is located closer to the rotary shaft 14 than the scroll bearing 17 in the axial direction of the rotary shaft 14. The thickness of the thin portion 39 is the dimension of in the axial direction of the rotary shaft 14. The thin portion 39 is located between the scroll bearing 17 and the rotary shaft 14 in the axial direction of the rotary shaft 14.

In the radial direction, the distal end of the thin portion 39 is located between the outer circumferential surface of the scroll bearing 17 and the inner circumferential surface of the shaft supporting member 21. The thick portion 38 is provided at the distal end of the thin portion 39. The thick portion 38 is located in the back pressure chamber 26. In the radial direction, the thick portion 38 is located between the outer circumferential surface of the boss portion 32*c* and the inner circumferential surface of the shaft supporting member 21. Thus, a part of the thick portion 38 is arranged to face the outer circumferential surface of the boss portion 32*c* in the radial direction of the cylindrical portion 37. Also, a part of the thick portion 38 is located on the inner side of the anti-rotation mechanisms 28 in the radial direction of the rotary shaft 14.

The dimension of the thick portion 38 in the axial direction of the rotary shaft 14 is greater than the dimension of the thin portion 39 in the axial direction of the rotary shaft 14. In other words, the dimension of the thin portion 39 in the axial direction of the rotary shaft 14 is smaller than the dimension of the thick portion 38 in the axial direction of the rotary shaft 14. That is, the thin portion 39 is located between the scroll bearing 17 and the rotary shaft 14 in the axial direction of the rotary shaft 14 and is thinner than the thick portion 38 in the axial direction of the rotary shaft 14.

The block-shaped thick portion 38 includes a first section 38*a*, which protrudes further in the axial direction toward the movable scroll 32 than the thin portion 39, and a second section 38*b*, which protrudes further in the axial direction toward the rotary shaft 14 than the thin portion 39. The dimension in the radial direction of the first section 38*a* is smaller than the dimension in the radial direction of the second section 38*b*. The dimension in the radial direction of the second section 38*b* is constant along the axial direction of the rotary shaft 14.

The distal end of the second section 38*b* is closer to the electric motor 16 than the first end face of the rotary shaft 14. Therefore, the second section 38*b* and a part (first end) of the rotary shaft 14 are arranged side by side in the radial direction.

As shown in FIG. 3, when viewed in the axial direction of the rotary shaft 14 the center of gravity Z of the bushing 36 is located on the thin portion 39 of the auxiliary weight portion 43 and is closer to the thick portion 38 than the central axis N of the cylindrical portion 37. As an imaginary plane including a cross section along the radial direction of the rotary shaft 14, a plane is assumed in which the center of gravity Z of the bushing 36 and the center of gravity X of the auxiliary weight portion 43 exist. When the bushing 36 is viewed in the axial direction of the rotary shaft 14, the center of gravity Z of the bushing 36 and the center of gravity X of the auxiliary weight portion 43 are located on the same side of the straight line T as the center (central axis M) of the eccentric shaft 35 when the imaginary plane is divided into two by the straight line T. Also, when viewed in the axial direction of the rotary shaft 14, the entire thick portion 38 is located on the same side of the straight line T as the center (central axis M) of the eccentric shaft 35.

A straight line Lb is now assumed that includes the center (central axis M) of the eccentric shaft 35 and the center (central axis L) of the rotary shaft 14. As viewed in the axial direction of the rotary shaft 14, the thick portion 38 is entirely located on the opposite side of the straight line Lb from the center of the movable-side base plate 32*a*, that is, from the center (central axis N) of the cylindrical portion 37. The center of the movable-side base plate 32*a* coincides with the center of gravity of the movable scroll 32. Therefore, the entire thick portion 38 and the center of gravity Z of the bushing Z are located in a region on the opposite side of the straight line Lb from the side on which the center of the movable-side base plate 32*a* (center of the cylindrical portion 37), specifically, the center of gravity of the movable-side base plate 32*a*, is located.

The bushing 36 swings when the scroll compressor 10 is activated or when the operating condition (for example, the speed of the movable scroll 32) changes. The swinging motion of the bushing 36 allows the orbital radius of the movable scroll 32 to be variable, which maintains a proper contact pressure between the stationary-side volute wall 31*b* and the movable-side volute wall 32*b*. The swing range of the bushing 36 is limited by the contact between a recess 41*a*, which will be discussed below, and the second section 38*b*.

The balancer 40 is fixed to the first end of the rotary shaft 14. The balancer 40 includes a balancer main body 41, which is semicircular when viewed in the axial direction of the rotary shaft 14, and a semi-annular holding portion 42, which is integrated with the balancer main body 41 to cover the outer circumferential surface of the rotary shaft 14. The holding portion 42 fixes the balancer 40 to the rotary shaft 14 together with the balancer main body 41. The balancer main body 41 is a main weight portion. The balancer main body 41 has the recess 41*a* on the end face closer to the movable scroll 32. The recess 41*a* of the balancer main body 41 receives the second section 38*b* of the bushing 36. The thick portion 38 of the bushing 36 is smaller in volume and weight than the balancer 40. The recess 41*a* is configured to allow the thick portion 38 to swing.

When the balancer 40 is viewed in the axial direction, the center of gravity V of the balancer 40 is on the opposite side of the center (central axis L) of the rotary shaft 14 from the center (central axis N) of the cylindrical portion 37. Since the central axis N of the cylindrical portion 37 coincides with the center of gravity of the movable scroll 32, the center of gravity V of the balancer 40 is on the opposite side of the central axis L of the rotary shaft 14 from the center of gravity of the movable scroll 32. Also, the balancer main body 41 is located on the opposite side of the central axis L of the rotary shaft 14 from the eccentric shaft 35.

During orbiting motion of the movable scroll 32, the movable scroll 32 receives a centrifugal force Fa on the opposite side from the balancer main body 41. At the same time, the balancer main body 41 receives a centrifugal force Fc on the opposite side from the movable scroll 32. Thus, during orbiting motion of the movable scroll 32, the centrifugal force Fa acting on the movable scroll 32 is cancelled by the centrifugal force Fc acting on the balancer main body 41, and the weight balance with the movable scroll 32 is achieved.

In FIG. 3, the rotary shaft 14 rotates clockwise. Accordingly, the balancer main body 41 also rotates clockwise. Due to the abutment between the recess 41*a* and the second section 38*b*, the auxiliary weight portion 43 rotates clockwise together with the balancer main body 41. At this time, due to the clockwise orbiting motion of the movable scroll 32, a moment Ma is generated about the eccentric shaft 35 by the centrifugal force Fa acting on the movable scroll 32. The direction of the moment Ma is the same as the direction of the orbiting motion of the movable scroll 32 and hence as the direction of the rotation of the rotary shaft 14. Thus, the clockwise moment Ma about the eccentric shaft 35 acts on the cylindrical portion 37.

Furthermore, as the rotary shaft 14 rotates, the auxiliary weight portion 43 receives a centrifugal force Fb, which generates a moment Mb about the eccentric shaft 35. The direction of the moment Mb is opposite to the direction of rotation of the rotary shaft 14 and is counterclockwise. As viewed in the axial direction of the rotary shaft 14, the entire auxiliary weight portion 43, including the center of gravity Z of the auxiliary weight portion 43, is located on the same side of the straight line T as the center of the eccentric shaft 35. This increases the moment Mb about the eccentric shaft 35 generated by the centrifugal force Fb acting on the auxiliary weight portion 43. Therefore, the clockwise moment Ma generated about the eccentric shaft 35 by the orbiting motion of the movable scroll 32, that is, the moment Ma generated by the centrifugal force Fa acting on the movable scroll 32, is cancelled by the counterclockwise moment Mb, which is generated about the eccentric shaft 35 by the centrifugal force Fb acting on the auxiliary weight portion 43. This reduces the vibration of the rotary shaft 14. The fitting hole 36*a* of the bushing 36 is formed at the position where the moment Ma by the centrifugal force Fa acting on the movable scroll 32 and the moment Mb by the centrifugal force Fb acting on the auxiliary weight portion 43 are in the opposite directions.

As viewed in the axial direction of the rotary shaft 14, the entire thick portion 38 of the bushing 36 is located on the opposite side of the straight line Lb from the center (central axis N) of the movable-side base plate 32*a*. As a result, the center of gravity Z of the bushing 36 is also located on the opposite side of the straight line Lb from the center of the movable-side base plate 32*a* and hence from the center of gravity of the movable scroll 32. That is, the center of gravity of the movable scroll 32 and the center of gravity Z of the bushing 36 are located on the opposite sides of the straight line Lb as viewed in the axial direction of the rotary shaft 14.

The vector of the centrifugal force Fa acting on the movable scroll 32 is generally located on a straight line including the center (central axis L) of the rotary shaft 14 and the center (central axis N), which is approximately the same as the center of gravity of the movable-side base plate 32*a*. The vector of the centrifugal force Fb acting on the auxiliary weight portion 43 is along a straight line including the center (central axis N) of the rotary shaft 14 and the center of gravity Z of the bushing 36. The center of gravity (central axis N) of the movable-side base plate 32*a* and the center of gravity Z of the bushing 36 are located on the opposite sides of the straight line Lb. The centrifugal forces that act on the center of gravity (central axis N) of the movable-side base plate 32*a* and the center of gravity Z of the bushing 36 respectively generate the moment Ma and the moment Mb about the center (central axis M) of the eccentric shaft 35, which are in the opposite directions.

In order to avoid interference between the thick portion 38 of the auxiliary weight portion 43 and the scroll bearing 17, it is necessary to extend the distal end of the thin portion 39 to a position beyond the outer circumferential surface of the boss portion 32*c*. This determines the length of the thin portion 39 in the radial direction. The weight of the auxiliary weight portion 43 is set such that the moment determined by the length of the thin portion 39 and the weight of the thick portion 38 cancel the moment generated by the orbiting motion of the movable scroll 32. The weight of auxiliary weight portion 43 is adjusted by adjusting the dimension of the thick portion 38 in the axial direction of the rotary shaft 14.

The operation of the scroll compressor 10 will now be described.

When power is supplied to the electric motor 16, so that the rotary shaft 14 rotates, the bushing 36 orbits about the rotary shaft 14, and the movable scroll 32 also orbits. At this time, the balancer 40 rotates integrally with the rotary shaft 14. Then, the centrifugal force Fa acting on the movable scroll 32 is cancelled by the centrifugal force Fc acting on the balancer main body 41.

When the operating condition changes (for example, when the speed changes) during the orbiting motion of the movable scroll 32, the orbital radius of the movable scroll 32 is adjusted by swinging motion of the bushing 36.

The first embodiment has the following advantages.

(1-1) The balancer 40 is integrated with the rotary shaft 14 so that the balancer main body 41 of the balancer 40 achieves weight balance with the movable scroll 32. Since the balancer 40 is separate from the bushing 36, the balancer 40 does not swing simultaneously with the bushing 36. Therefore, vibration of the rotary shaft 14 accompanying the swinging motion of the balancer 40 is suppressed.

The center of gravity Z of the bushing 36 is located on the same side of the straight line T as the center (central axis M) of eccentric shaft 35, and the centrifugal force Fb acts on the bushing 36 on the side of the straight line T corresponding to the auxiliary weight portion 43. The bushing 36 has the auxiliary weight portion 43, and the fitting hole 36*a* of the bushing 36 is provided at a position where the moment Ma by the centrifugal force Fa acting on the movable scroll 32 and the moment Mb by the centrifugal force Fb acting on the auxiliary weight portion 43 are in the opposite directions. As a result, even if a moment is generated about the eccentric shaft 35, that moment can be cancelled. This reduces the load applied to the first bearing 22, which supports the rotary shaft 14, and thus allows the size of the first bearing 22 to be reduced. Furthermore, the center of gravity Z of the bushing 36 is on the same side of the straight T as the center (central axis M) of the eccentric shaft 35. This increases the moment Mb about the eccentric shaft 35 generated by the centrifugal force Fb acting on the auxiliary weight portion 43. As a result, the auxiliary weight portion 43 is allowed to be reduced in size.

(1-2) Since the balancer 40 rotates integrally with the rotary shaft 14, the balancer 40 does not swing. Therefore, it is not necessary to reduce the weight by taking swinging motion of the balancer 40 into consideration, and it is easy to achieve weight balance with the movable scroll 32.

(1-3) The balancer main body 41 for achieving weight balance with the movable scroll 32 is arranged in the back pressure chamber 26. Since the back pressure chamber 26 is an existing space in the scroll compressor 10, the enlargement of the shaft supporting member 21, and hence that of the scroll compressor 10, are limited.

(1-4) The auxiliary weight portion 43 of the bushing 36 is arranged in the back pressure chamber 26, and the balancer 40 and the auxiliary weight portion 43 are arranged in the back pressure chamber 26. Since the back pressure chamber 26 is an existing space in the scroll compressor 10, there is no need to newly provide a space for accommodating the balancer 40 and the auxiliary weight portion 43. Therefore, the scroll compressor 10 is not increased in size due to an accommodation space for the balancer 40 and the auxiliary weight portion 43.

(1-5) The thin portion 39 of the bushing 36 is thinner than the thick portion 38, and the thick portion 38 has a shape of a block. The thin portion 39 and the thick portion 38 are smaller in volume and weight than the balancer 40. Therefore, as compared with a case in which the balancer 40 is integrated with the cylindrical portion 37 of the bushing 36, fluctuation of weight balance due to swinging motion of the auxiliary weight portion 43 is reduced. This suppresses vibration of the rotary shaft 14.

(1-6) Since the balancer 40 has the recess 41*a*, the auxiliary weight portion 43 is allowed to be extended in the axial direction of the rotary shaft 14. This facilitates adjustment of the weight of the auxiliary weight portion 43.

(1-7) The auxiliary weight portion 43 of the bushing 36 has the thick portion 38 and the thin portion 39, and is located on the same side of the straight line T as the center (central axis M) of the eccentric shaft 35. Even if the position of the bushing 36 changes slightly due to manufacturing tolerances or assembling tolerances of the bushing 36 when the bushing 36 is assembled to the rotary shaft 14, the center of gravity Z of the bushing 36 can be positioned on the same side of the straight line T as the center of the eccentric shaft 35.

(1-8) As viewed in the axial direction of the rotary shaft 14, the entire auxiliary weight portion 43, including the center of gravity X of the auxiliary weight portion 43, is located on the same side of the straight line T as the center of the eccentric shaft 35. This increases the moment Mb about the eccentric shaft 35 generated by the centrifugal force Fb acting on the auxiliary weight portion 43, allowing the auxiliary weight portion 43 to be reduced in size.

(1-9) The auxiliary weight portion 43 of the bushing 36 has the thick portion 38 and the thin portion 39. The thick portion 38 is located on the inner side of the anti-rotation mechanisms 28 in the radial direction of the rotary shaft 14. As a result, the scroll compressor 10 is not increased in size.

(1-10) As viewed in the axial direction of the rotary shaft 14, the entire thick portion 38 of the bushing 36 is located on the opposite side of the straight line Lb from the center (central axis N) of the movable-side base plate 32*a*. As a result, the center of gravity Z of the bushing 36 is also located on the opposite side of the straight line Lb from the center of the movable-side base plate 32*a* and hence from the center of gravity of the movable scroll 32. The vector of the centrifugal force Fa acting on the movable scroll 32 is generally located on a straight line including the center (central axis L) of the rotary shaft 14 and the center (central axis N), which is approximately the same as the center of gravity of the movable-side base plate 32*a*. The vector of the centrifugal force Fb acting on the auxiliary weight portion 43 extends along a straight line including the center (central axis N) of the rotary shaft 14 and the center of gravity Z of the bushing 36. The center of gravity (central axis N) of the movable-side base plate 32*a* and the center of gravity Z of the bushing 36 are located on the opposite sides of the straight line Lb. The centrifugal forces that act on the center of gravity (central axis N) of the movable-side base plate 32*a* and the center of gravity Z of the bushing 36 respectively generate the moment Ma and the moment Mb about the center (central axis M) of the eccentric shaft 35, which are in the opposite directions. As a result, the auxiliary weight portion 43 is allowed to be reduced in size.

Second Embodiment

A scroll compressor according to a second embodiment will now be described with reference to FIG. 4. The detailed description of the configuration of the second embodiment that is the same as or overlaps with the first embodiment will be omitted.

Figure 4:
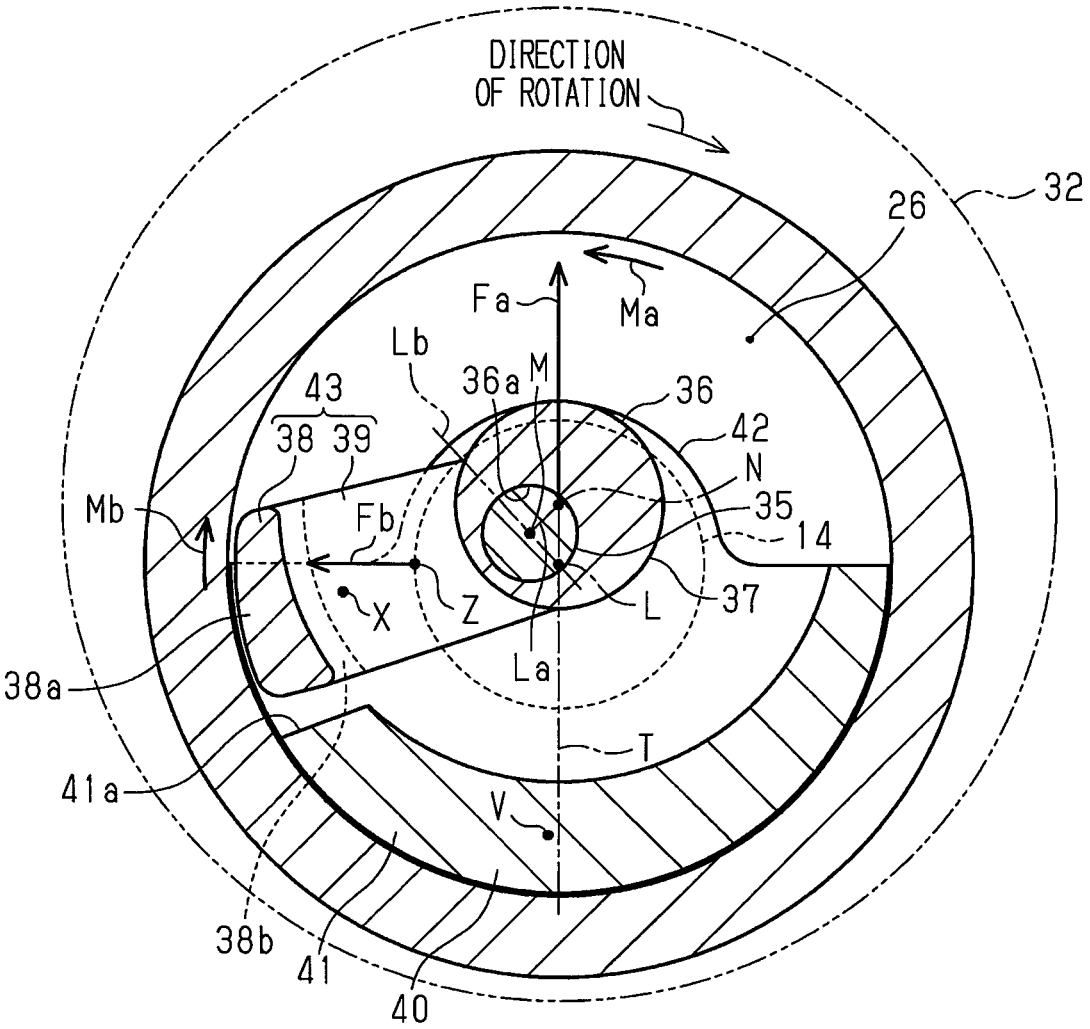
FIG. 4 is a cross-sectional view showing a rotary shaft, a balancer, and a bushing according to a second embodiment.

As shown in FIG. 4, the center (central axis M) of the fitting hole 36*a* and the eccentric shaft 35 is located on the outer side of the center (central axis N) of the cylindrical portion 37 in the radial direction. Specifically, as viewed in the axial direction of the rotary shaft 14, the center of the fitting hole 36*a* is closer to the auxiliary weight portion 43 than the center of cylindrical portion 37 and closer to the balancer 40 than the central axis N in the radial direction. The center of the cylindrical portion 37 is offset from the center of the fitting hole 36*a* in the radial direction. The center of the fitting hole 36*a* is located closer to the auxiliary weight portion 43 than the straight line T including the center of the rotary shaft 14 and the center of the cylindrical portion 37.

A line segment La connecting the center (central axis N) of the cylindrical portion 37 to the center (central axis M) of the eccentric shaft 35 is longer than the line segment connecting the center (central axis N) of the cylindrical portion 37 and the center (central axis M) of the eccentric shaft 35 in the first embodiment. The fitting hole 36*a* and the eccentric shaft 35 are thus closer to the central axis L on the first end face of the rotary shaft 14 than in the first embodiment. When a load is applied to the bushing 36 by orbiting motion of the movable scroll 32, the eccentric shaft 35 acts to push the cylindrical portion 37. As viewed in the axial direction of the rotary shaft 14, the center of gravity Z of the bushing 36 is on the same side of the straight line T as the center (central axis M) of the eccentric shaft 35 when the imaginary plane is divided by the straight line T.

In the second embodiment, when the movable scroll 32 orbits, a moment Ma is generated about the eccentric shaft 35 by the centrifugal force Fa acting on the movable scroll 32 as the rotary shaft 14 rotates. The moment Ma is opposite to the rotational direction of the rotary shaft 14. At the same time, when the movable scroll 32 orbits, a moment Mb is generated about the eccentric shaft 35 by the centrifugal force Fb acting on the auxiliary weight portion 43 as the rotary shaft 14 rotates. The moment Mb is the same direction as the rotational direction of the rotary shaft 14. Therefore, the moment Ma by the centrifugal force Fa acting on the movable scroll 32 and the moment Mb by the centrifugal force Fb acting on the auxiliary weight portion 43 are in the opposite directions. The fitting hole 36*a* of the bushing 36 is formed at the position where the moment Ma by the centrifugal force Fa acting on the movable scroll 32 and the moment Mb by the centrifugal force Fb acting on the auxiliary weight portion 43 are in the opposite directions. Specifically, as viewed in the axial direction of the rotary shaft 14, the entire thick portion 38 of the bushing 36 is located on the opposite side of the straight line Lb, which includes the center (central axis M) of the eccentric shaft 35 and the center (central axis L) of the rotary shaft 14, from the center (central axis N) of the movable-side base plate 32*a*. That is, the center of gravity of the movable scroll 32 and the center of gravity Z of the bushing 36 are located on the opposite sides of the straight line Lb as viewed in the axial direction of the rotary shaft 14. The two moments Ma and Mb thus cancel each other.

In addition to the advantages (1-1) to (1-10) of the first embodiment, the second embodiment provides the following advantage.

(2-1) The line segment La connecting the center (central axis N) of the cylindrical portion 37 and the center (central axis M) of the eccentric shaft 35 is longer than in the first embodiment. For this reason, even if the angle of swinging motion of the bushing 36 is small, the revolution radius of the movable scroll 32 can be adjusted.

The above-described embodiments may be modified as follows. The above-described embodiments and the following modifications can be combined as long as the combined modifications remain technically consistent with each other.

In each of the above-described embodiments, the dimension of the thin portion 39 in the axial direction or the dimension of the thin portion 39 in the radial direction may be changed as long as the center of gravity Z of the bushing 36 is on the same side of the straight line T as the center (central axis M) of the eccentric shaft 35. Also, the auxiliary weight portion 43 may have a constant dimension in the axial direction. That is, the auxiliary weight portion 43 may be configured without the thick portion 38 or the thin portion 39.

Figure 5:
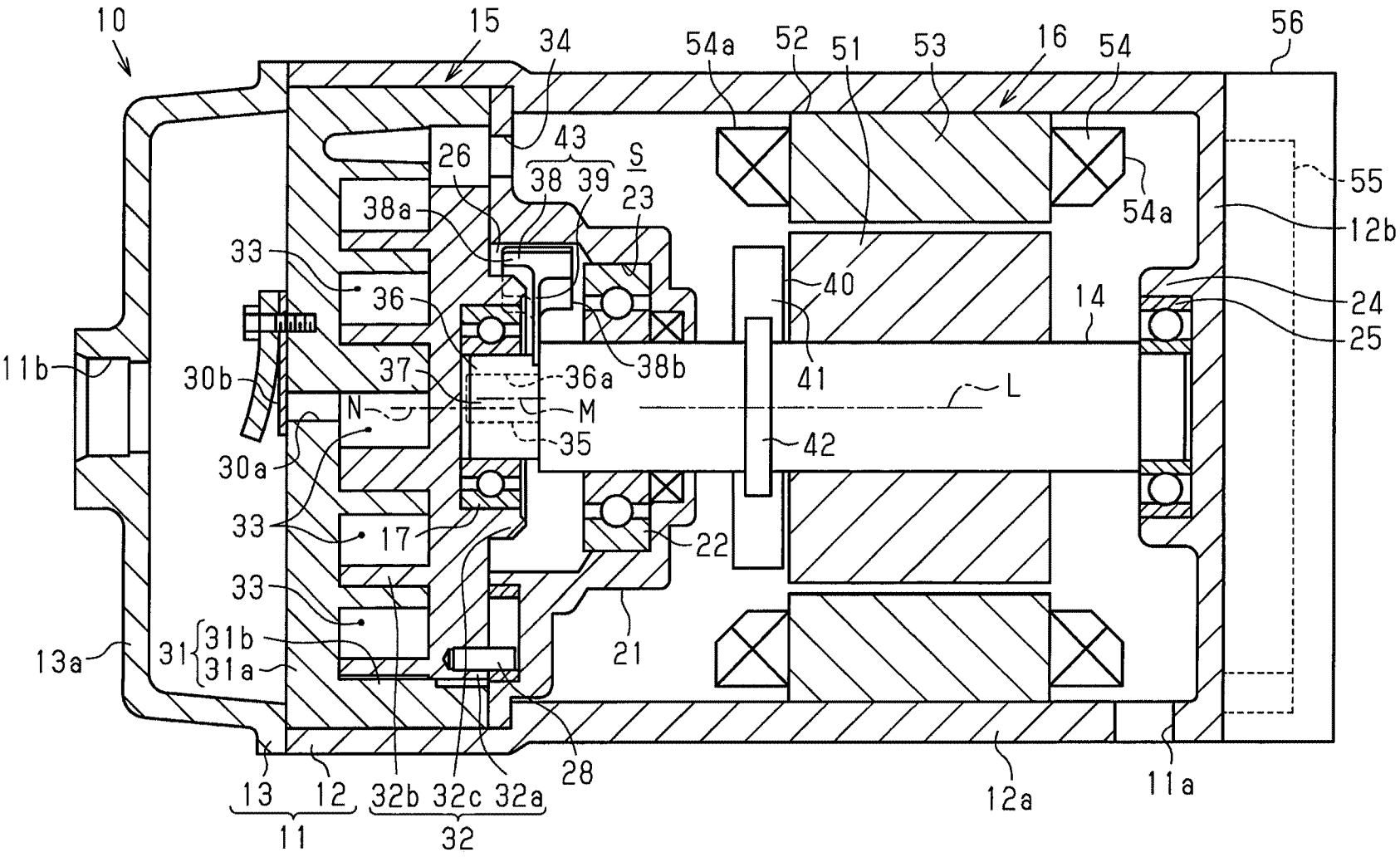
FIG. 5 is a cross-sectional view showing a scroll compressor according to a modification.

As shown in FIG. 5, in the second embodiment, the balancer 40 may be arranged in the space between the electric motor 16 and the shaft supporting member 21 in the axial direction in the motor accommodating chamber S. That is, the balancer 40 does not need to be arranged in the back pressure chamber 26. In this case, the balancer 40 is integrated with the rotary shaft 14 by the holding portion 42.

In this configuration, as compared with a case in which the balancer 40 is arranged in the back pressure chamber 26, the back pressure chamber 26 is reduced in size in the axial direction by the amount corresponding to the balancer 40, so that the first bearing 22 is brought closer to the movable scroll 32. As a result, the distance in the axial direction between the first bearing 22 and the second bearing 25 is increased, and the distance between the first bearing 22 and the scroll bearing 17 is reduced. This configuration reduces the load applied to the first bearing 22 and the second bearing 25 due to the compressive force and the centrifugal force acting on the movable scroll 32.

In the first embodiment, the balancer main body 41 of the balancer 40 may be located outside the back pressure chamber 26, for example, in the motor accommodating chamber S.

In each of the above-described embodiments, the rotary shaft 14 and the balancer main body 41 may be integrally formed as a single member.

In each of the above-described embodiments, the entire thick portion 38 may face the outer circumferential surface of the boss portion 32*c* in the radial direction of the cylindrical portion 37. That is, the thick portion 38 may be configured to include only the first section 38*a*.

In each of the above-described embodiments, the entire thick portion 38 may be located on the inner side of the anti-rotation mechanisms 28 in the radial direction of the rotary shaft 14. That is, the thick portion 38 may be configured to include only the first section 38*a*.

In each of the above-described embodiments, the thick portion 38 does not need to be divided into the first section 38*a* and the second section 38*b*, but may have a constant dimension in the axial direction of the rotary shaft 14.

In the bushing 36 of each of the above-described embodiments, the fitting hole 36*a* does not need to extend through the cylindrical portion 37.

In each of the above-described embodiments, if the auxiliary weight portion 43 is entirely located on the opposite side of the center N of the movable-side base plate 32*a* from the straight line including the center M of the eccentric shaft 35 and the center L of the rotary shaft 14, the auxiliary weight portion 43 may be configured without the thick portion 38 or the thin portion 39, but may have a constant thickness along the axial direction of the rotary shaft 14.

In each of the above-described embodiments, the scroll compressor 10 may be of a type that does not have the back pressure chamber 26.

In each of the above-described embodiments, the center of gravity of the movable scroll 32 and the center of gravity Z of the bushing 36 may be located on the opposites of the straight line including the center of the eccentric shaft 35 and the center of the rotary shaft 14 as viewed in the axial direction of the rotary shaft 14.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A scroll compressor comprising:

a rotary shaft;

an electric motor that rotates integrally with the rotary shaft;

an eccentric shaft that is provided at a distal end of the rotary shaft;

a stationary scroll that has a stationary-side base plate and a stationary-side volute wall extending from the stationary-side base plate;

a moveable scroll that is configured to compress fluid by rotation of the rotary shaft, the movable scroll comprising a disk-shaped movable-side base plate that faces the stationary-side base plate, a movable-side volute wall that extends from the movable-side base plate toward the stationary-side base plate and meshes with the stationary-side volute wall, and a boss portion that extends from the movable-side base plate toward the rotary shaft and is arranged about a central axis of the movable-side base plate;

a shaft supporting member that has an insertion hole in which the rotary shaft is inserted, a rotary shaft bearing for supporting the rotary shaft being arranged in the insertion hole;

a bushing that has a fitting hole in which the eccentric shaft is fitted;

a scroll bearing that is fitted to an inner circumferential surface of the boss portion and fitted to an outer circumferential surface of the bushing; and a balancer that rotates integrally with the rotary shaft;

a compression portion including the stationary scroll and the movable scroll;

a housing accommodating the compression portion and the electric motor;

a motor accommodating chamber defined by the shaft supporting member and accommodating the electric motor;

an inlet extending through the housing and communicating the motor accommodating chamber with the outside of the housing, a suction passage extending through the shaft supporting member and communicating the motor accommodating chamber with the compression portion, and a back pressure chamber defined by the movable-side base plate and the shaft supporting member, wherein the central axis of the movable-side base plate is located at a different position from a central axis of the eccentric shaft, the bushing comprises a cylindrical portion that is fitted to an inner circumferential surface of the scroll bearing, the fitting hole extending through the cylindrical portion along an axial direction of the cylindrical portion, and an auxiliary weight portion that is located on an outer side of the cylindrical portion in a radial direction, wherein the auxiliary weight portion is accommodated in the back pressure chamber, the fitting hole is provided at a position where a moment about the eccentric shaft generated by a centrifugal force acting on the movable scroll due to rotation of the rotary shaft and a moment about the eccentric shaft generated by a centrifugal force acting on the auxiliary weight portion due to rotation of the rotary shaft are in opposite directions, as viewed in an axial direction of the rotary shaft, a center of gravity of the bushing is located on a same side of a straight line, which passes through a center of the cylindrical portion and a center of the rotary shaft, as a center of the eccentric shaft, the balancer is accommodated in the motor accommodating chamber, the suction passage is located radially outside the back pressure chamber, and the auxiliary weight portion is smaller in volume and weight than the balancer.

2. The scroll compressor according to claim 1, wherein, as viewed in the axial direction of the rotary shaft, a center of gravity of the auxiliary weight portion is located on the same side of the straight line including the center of the cylindrical portion and the center of the rotary shaft as the center of the eccentric shaft.

3. The scroll compressor according to claim 2, wherein, as viewed in the axial direction of the rotary shaft, the auxiliary weight portion is entirely located on the same side of the straight line including the center of the cylindrical portion and the center of the rotary shaft as the center of the eccentric shaft.

4. The scroll compressor according to claim 1, wherein the auxiliary weight portion includes a thin portion that extends from an outer circumferential surface of the cylindrical portion in a radial direction of the cylindrical portion, and a thick portion that is provided on an outer side of the thin portion in the radial direction and has a dimension in the axial direction of the rotary shaft that is greater than that of the thin portion, and as viewed in the axial direction of the rotary shaft, the thick portion is entirely located on the same side of the straight line including the center of the cylindrical portion and the center of the rotary shaft as the center of the eccentric shaft.

5. The scroll compressor according to claim 4, wherein at least a part of the thick portion is arranged to face an outer circumferential surface of the boss portion in the radial direction of the cylindrical portion, and the thin portion is arranged between the scroll bearing and the rotary shaft in the axial direction of the rotary shaft.

6. The scroll compressor according to claim 5, wherein the back pressure chamber is configured to introduce fluid for pressing the movable scroll against the stationary scroll.

7. The scroll compressor according to claim 5, wherein the movable scroll includes an anti-rotation mechanism, and at least a part of the thick portion is arranged on an inner side of the anti-rotation mechanism in a radial direction of the rotary shaft.

8. A scroll compressor comprising:

a rotary shaft;

an electric motor that rotates integrally with the rotary shaft;

an eccentric shaft that is provided at a distal end of the rotary shaft;

a stationary scroll that has a stationary-side base plate and a stationary-side volute wall extending from the stationary-side base plate;

a moveable scroll that is configured to compress fluid by rotation of the rotary shaft, the movable scroll comprising a disk-shaped movable-side base plate that faces the stationary-side base plate, a movable-side volute wall that extends from the movable-side base plate toward the stationary-side base plate and meshes with the stationary-side volute wall, and a boss portion that extends from the movable-side base plate toward the rotary shaft and is arranged about a central axis of the movable-side base plate;

a shaft supporting member that has an insertion hole in which the rotary shaft is inserted, a rotary shaft bearing for supporting the rotary shaft being arranged in the insertion hole;

a bushing that has a fitting hole in which the eccentric shaft is fitted;

a scroll bearing that is fitted to an inner circumferential surface of the boss portion and fitted to an outer circumferential surface of the bushing;

a balancer that rotates integrally with the rotary shaft;

an electric motor that rotates integrally with the rotary shaft;

a compression portion including the stationary scroll and the movable scroll;

a housing accommodating the compression portion and the electric motor;

a motor accommodating chamber defined by the shaft supporting member and accommodating the electric motor;

an inlet extending through the housing and communicating the motor accommodating chamber with the outside of the housing, a suction passage extending through the shaft supporting member and communicating the motor accommodating chamber with the compression portion, and a back pressure chamber defined by the movable-side base plate and the shaft supporting member, wherein the central axis of the movable-side base plate is located at a different position from a central axis of the eccentric shaft, the bushing comprises a cylindrical portion that is fitted to an inner circumferential surface of the scroll bearing, the fitting hole extending through the cylindrical portion along an axial direction of the cylindrical portion, and an auxiliary weight portion that is located on an outer side of the cylindrical portion in a radial direction, wherein the auxiliary weight portion is accommodated in the back pressure chamber, the fitting hole is provided at a position where a moment about the eccentric shaft generated by a centrifugal force acting on the movable scroll due to rotation of the rotary shaft and a moment about the eccentric shaft generated by a centrifugal force acting on the auxiliary weight portion due to rotation of the rotary shaft are in opposite directions, the balancer is accommodated in the motor accommodating chamber, the suction passage is located radially outside the back pressure chamber, and the auxiliary weight portion is smaller in volume and weight than the balancer.

9. The scroll compressor according to claim 8, wherein, as viewed in the axial direction of the rotary shaft, a center of gravity of the auxiliary weight portion is located on the same side of the straight line, which passes through the center of the cylindrical portion and the center of the rotary shaft, as the center of the eccentric shaft.

10. The scroll compressor according to claim 9, wherein, as viewed in the axial direction of the rotary shaft, the auxiliary weight portion is entirely located on the same side of the straight line, which passes through the center of the cylindrical portion and the center of the rotary shaft, as the center of the eccentric shaft.

11. The scroll compressor according to claim 8, wherein the auxiliary weight portion includes a thin portion that extends from an outer circumferential surface of the cylindrical portion in a radial direction of the cylindrical portion, and a thick portion that is provided on an outer side of the thin portion in the radial direction and has a dimension in the axial direction of the rotary shaft that is greater than that of the thin portion, and as viewed in the axial direction of the rotary shaft, the thick portion is entirely located on the same side of the straight line, which passes through the center of the cylindrical portion and the center of the rotary shaft, as the center of the eccentric shaft.

12. The scroll compressor according to claim 11, wherein at least a part of the thick portion is arranged to face an outer circumferential surface of the boss portion in the radial direction of the cylindrical portion, and the thin portion is arranged between the scroll bearing and the rotary shaft in the axial direction of the rotary shaft.

13. The scroll compressor according to claim 12, wherein the movable scroll includes an anti-rotation mechanism, and at least a part of the thick portion is arranged on an inner side of the anti-rotation mechanism in a radial direction of the rotary shaft.

* * * * *